United States Patent [19]

Powell

[11] Patent Number: 5,073,124

[45] Date of Patent: Dec. 17, 1991

[54] ELECTRICAL INTERCONNECTION SYSTEM UTILIZING FLUID PRESSURE DEFORMED TUBULAR CONTACT

[75] Inventor: Francis R. Powell, Cheshire, Conn.

[73] Assignee: AMP Incorporated, Harrisburg, Pa.

[21] Appl. No.: 556,062

[22] Filed: Jul. 20, 1990

[51] Int. Cl.[5] ..... H01R 4/60; H01H 35/30

[52] U.S. Cl. ..... 439/197; 200/83 B; 200/83 N; 361/413; 361/380; 439/263

[58] Field of Search ..... 200/61.43, 83, 86 R, 200/505, 511, 51.09, 51.1, 81 R; 439/197, 263, 264; 361/380–416

[56] References Cited

U.S. PATENT DOCUMENTS

| | | | |
|---|---|---|---|
| 1,634,665 | 7/1927 | Hedley et al. | 200/61.43 |
| 2,135,131 | 11/1938 | Bassett | 200/61.43 |
| 2,824,183 | 2/1958 | Marasco et al. | 200/51.09 |
| 2,843,694 | 7/1958 | Bertaux | 200/86 R |
| 3,027,435 | 3/1962 | Shlesinger, Jr. | 200/83 |
| 3,304,386 | 2/1967 | Shlesinger, Jr. | 200/83 B |
| 3,706,864 | 12/1972 | Gamble | 200/83 B |
| 4,295,699 | 10/1981 | DuRocher | 200/511 X |
| 4,492,832 | 1/1985 | Taylor | 200/505 X |
| 5,002,496 | 3/1991 | Fox, Jr. | 439/197 |

*Primary Examiner*—J. R. Scott

[57] ABSTRACT

An electrical interconnection is provided between a tubular element (10) formed of a thin walled plastic material made conductive (16) and a further contact (18,56) by fluid pressure driving the material to engage the further contact. Positive and negative pressures are contemplated and assemblies (110) of contacts (90) are arranged to become commonly activated to interconnect arrays of contacts between electronic packages.

33 Claims, 11 Drawing Sheets

14
10
16
12
16
14
12
10
18
20
14
10
16
18
20
14
10
A.C.
1C
1C
14
19
19
14

12
20
16
14
18
20
16
12
18
14

35
32
30
34
33
35
30
32
33

36
38
36
38
32
33
35
2C
2C
A.C 35
38
36
33
37
35
34
37
33
36
38

45
47
44
40
42
45
44
40
42
46
48
44
47
46
48
44

3C
3C
A.C.
45
44
47
48
46
47

45
46
48

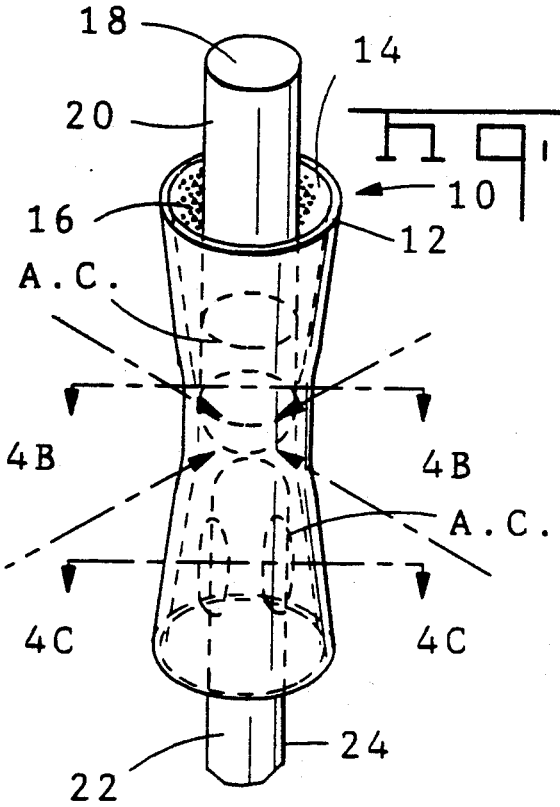
FIG. 4A
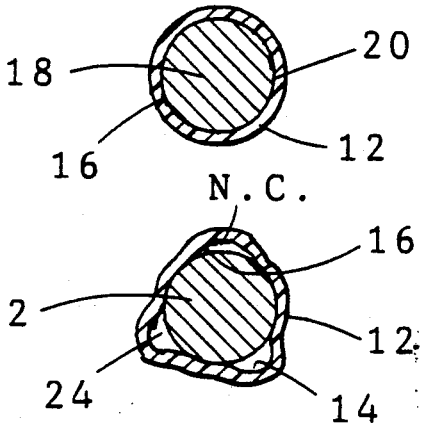
FIG. 4B
FIG. 4C
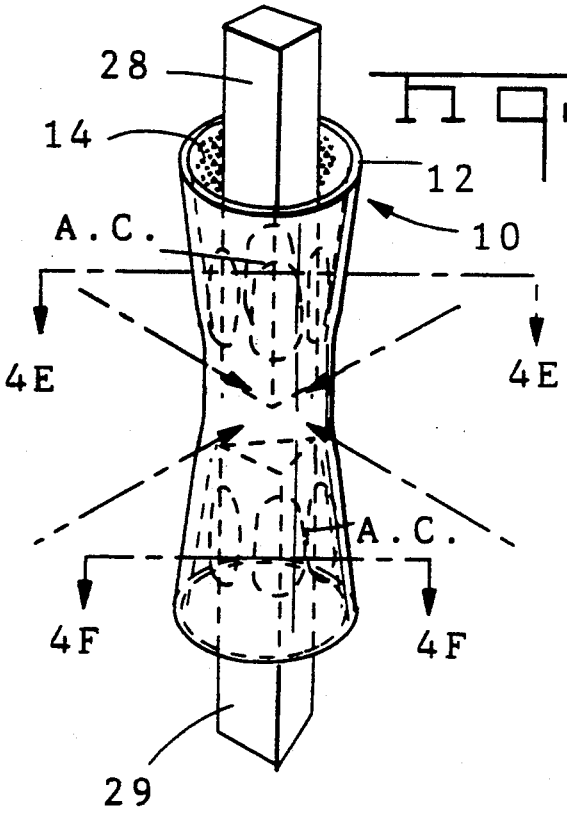
FIG. 4D
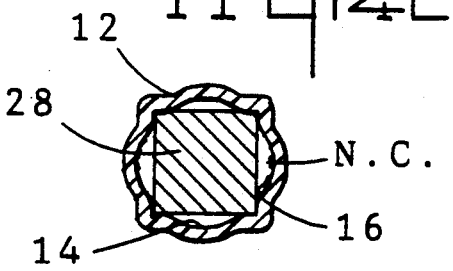
FIG. 4E
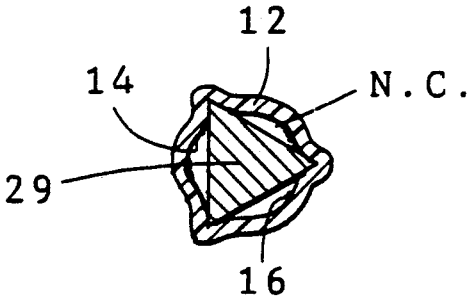
FIG. 4F 84
85
82
80
86
84
82
80
86

88
89
82
80
88
89
80
82
86
86
7C
7C 80
86
88
89
80
86
88
89

Fig. 8A
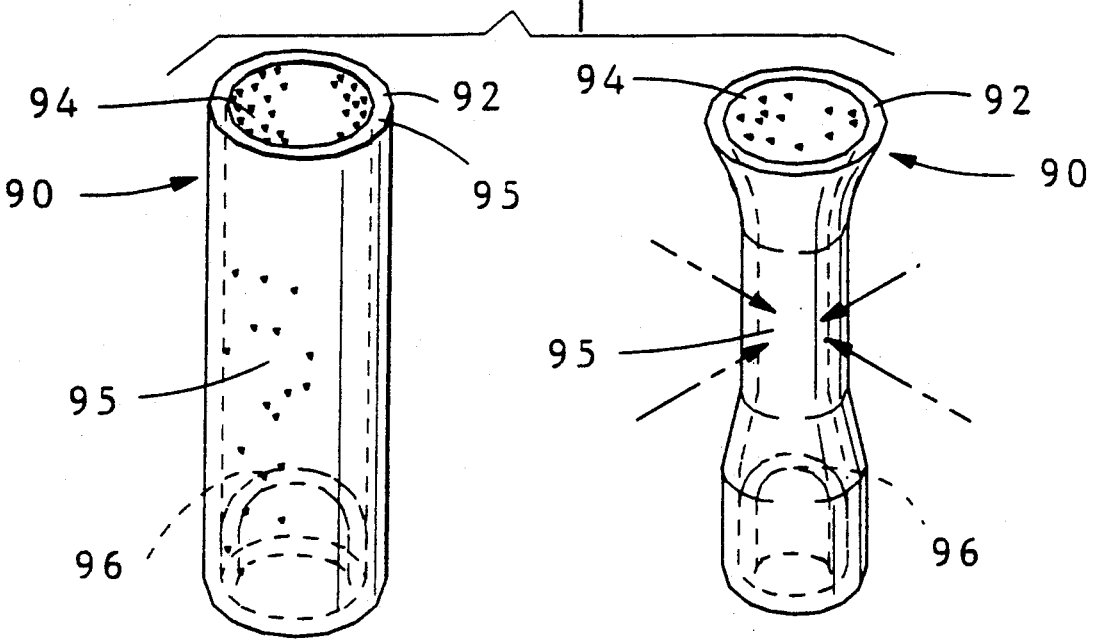
Fig. 8B
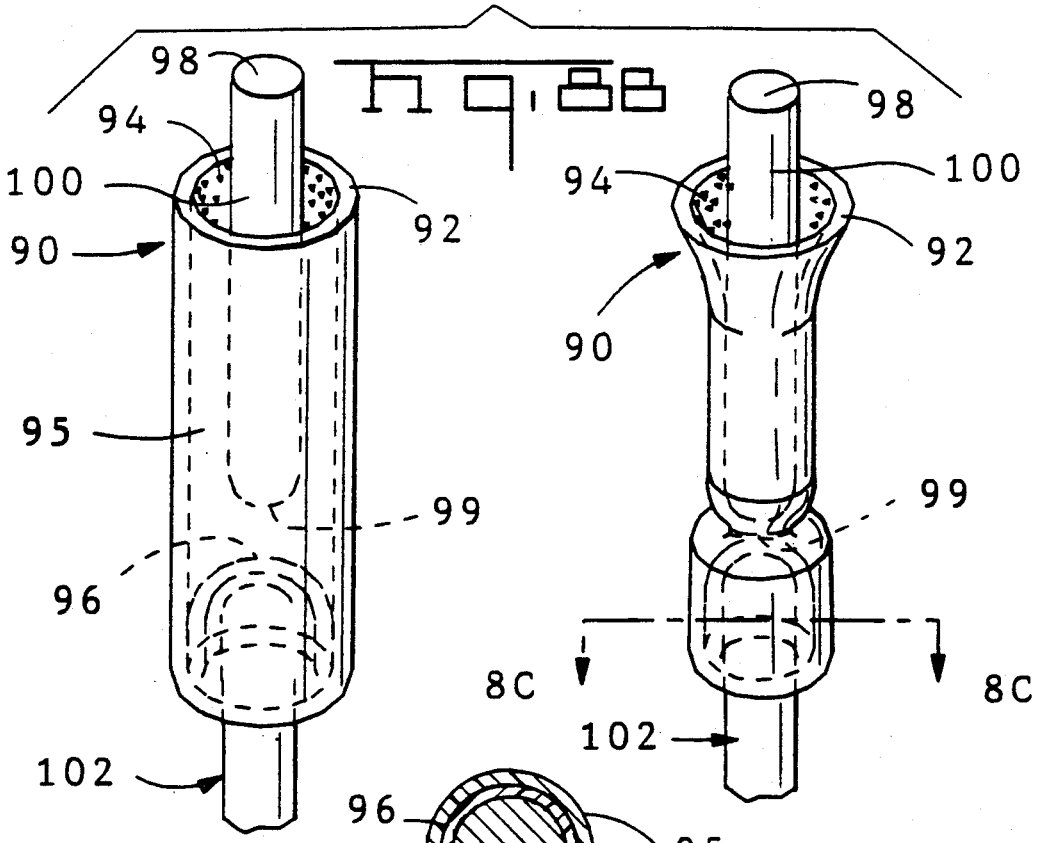
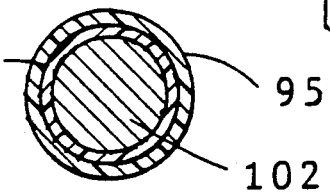
Fig. 8C

ELECTRICAL INTERCONNECTION SYSTEM UTILIZING FLUID PRESSURE DEFORMED TUBULAR CONTACT

FIELD OF INVENTION

This invention relates to an electrical contact and interconnection system based upon thin wall tubular elements driven by fluid pressure to effect an interconnection between electrical circuit paths.

BACKGROUND OF THE INVENTION

The development of integrated circuits utilized to provide logic and memory functions for a wide range of applications from computers to telecommunications equipment, business equipment and industrial control systems and a host of consumer products has sponsored two trends in interconnection. The first trend is toward higher densities where electrical interconnections between integrated circuit leads and electrical packaging devices and eventually functioning devices have become greater with center to center spacings ever closer together. The second trend is that the numbers of interconnections in a given area have increased to a point of forcing the dimensions of contacts and terminals to become so small as to create difficulties of manufacture and assembly. Thus, for example, the centerline spacings of 0.100 inches employing pins or their equivalent on the order of 0.050 inches in diameter with pin counts of on the order of fifty to one hundred fifty have yielded under this pressure to pin counts in excess of five hundred employing pins having diameters of under 0.020 inches in diameter. High pin counts have in turn generated another problem which is related to the insertion forces of I.C. packages having hundreds of pins. This has in turn generated families of so called zero insertion force or low insertion force connectors which employ complex and expensive mechanical means to open spring contacts allowing pin insertion at zero or low force and thereafter close such contacts to effect a mass interconnection.

The invention accordingly has as a principal object the provision of a connector interconnect system which facilitates the use of large numbers of interconnection devices on close centerlines for high density electronic packaging. The invention has a further object to provide a simple and reliable contact which may be driven for connect and disconnect functions by simple and common driving means. A still further object to is to provide an improved interconnection concept having fewer parts than heretofore available and capable of being rendered in extremely small cross-sectional profile.

Yet another object is to provide an interconnection scheme wherein a large number of interconnects may be actuated by pressure generating means operating on all contacts to effect a connect or disconnect function.

The final object of the invention is to provide an interconnect which has either a zero insertion force or a very low insertion force with respect to a mating contact.

SUMMARY OF INVENTION

The present invention achieves the foregoing objects by providing a tubular element formed of thin wall tubing of a material and/or geometry which is flexible and which is made to include conductive particles therewithin or on a surface thereof and to be driven by pressure to engage a further contact element to provide an interconnection. In one embodiment the tubular element is made of an elastomeric material which is driven to expand or contract its geometric shape elastomerically under fluid pressure. A second embodiment embraces a tubular element formed of an even thinner material which is non-elastomeric but made to carry conductive material on its surface and driven to deform inelastically by fluid pressure to effect an interconnect. The invention contemplates forms in both embodiments which can be driven by fluid pressure to contract and engage one or more pin like contact elements inserted within the tubular element; or, a negative pressure causing the tubular element to expand and interconnect one or more contact elements outside the tubular element.

The invention contemplates arrays or assemblies of tubular elements secured in housings adapted to receive matching arrays of pins from an electronic package such as a large scale integrated circuit, with the package containing fluid means operable to effect the deformation and/or expansion of the tubular elements to effect an interconnect.

BRIEF DESCRIPTION OF THE DRAWINGS

FIG. 4A is a perspective of a tubular element in an activated condition interconnecting a plurality of pin elements of different diameters.

FIG. 4B represents cross-sectional views taken through the upper portions of the element in FIG. 4A.

FIG. 4C represents a cross-sectional view taken through the lower portions of the element shown in FIG. 4A.

FIG. 4D is a perspective of a tubular element activated to interconnect a plurality of pins of square and triangular geometries.

FIG. 4E is a cross-sectional view taken through the upper portions of the element of FIG. 4D.

FIG. 4F is a cross-sectional view taken through the lower portion of FIG. 4D.

FIG. 8A is a view of tubular elements in accordance with the invention in relaxed and activated conditions including a closed end embodiment.

FIG. 8B is a view of the elements of FIG. 8A having pin contact elements inserted therein.

FIG. 8C is a cross-sectional view of the lower end of the tubular element of FIG. 8B.

DETAILED DESCRIPTION OF THE PREFERRED EMBODIMENT

Figures 1A, 1B, 1C:
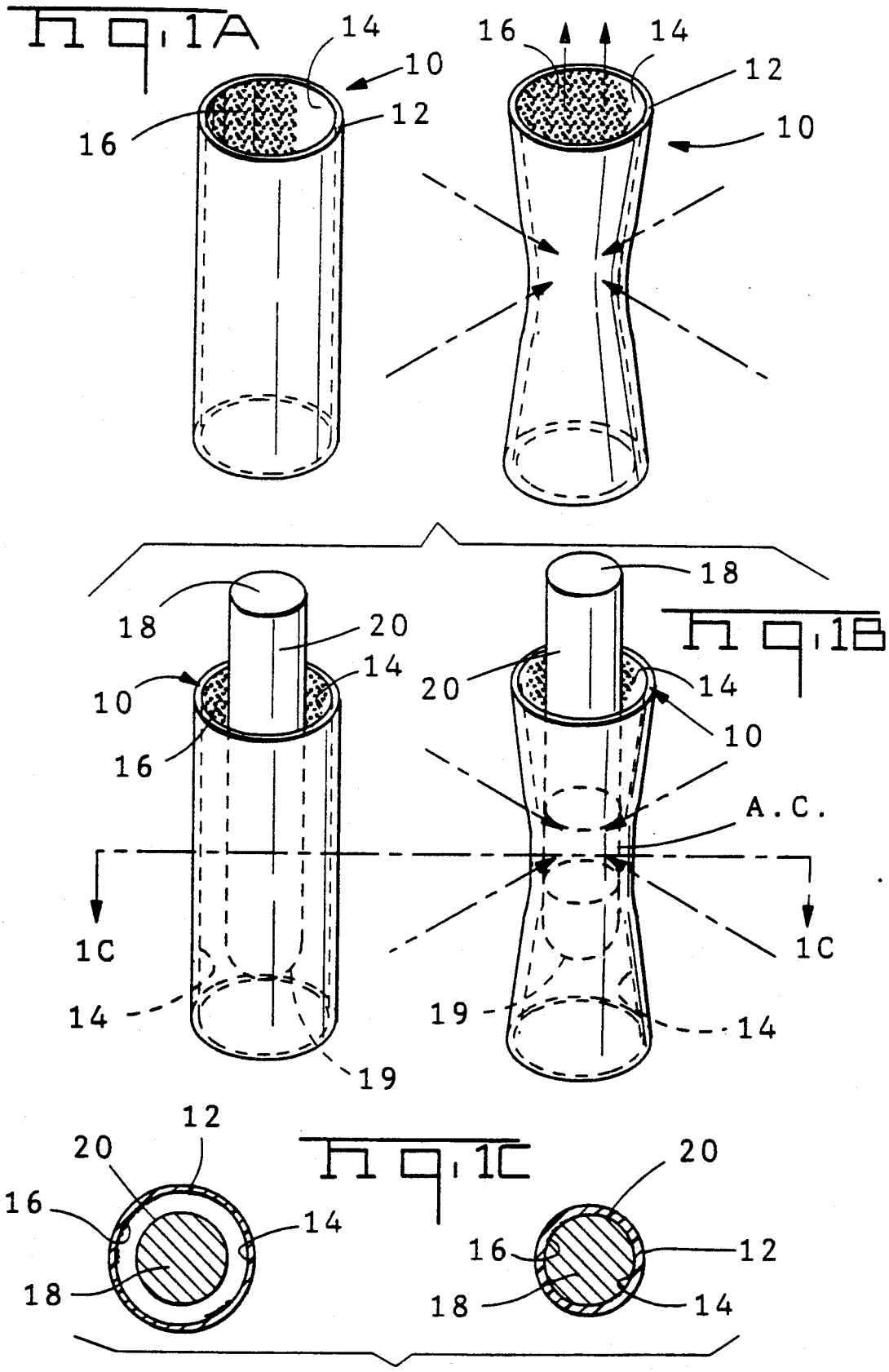
FIG. 1A is a perspective showing the tubular element of the invention in relaxed and contracted conditions.
FIG. 1B is a view of the element in FIG. 1A having contact pins inserted therein.
FIG. 1C is a cross-sectional view taken through the centerline of the view shown in FIG. 1B.

Referring now to FIG. 1, a tubular element 10 is shown to include a wall 12 having an inner surface 14 defining a central aperture extending therethrough. As will be hereinafter apparent the invention contemplates a use of a tubular element which is flexible to embrace closed wall structures of varying geometries other than purely circular. The embodiment shown in FIGS. 1A-5C contemplate a material forming 12 which may be elastomeric, materials such as alloys of natural rubber, neoprene, silicone and a variety of other materials which are elastomeric by nature and which have memory. By this is meant that the molded or cast geometry, if deformed to some other shape by some means, will upon removal of that means, return toward the undeformed shape.

Located interiorly of contact element 10 on the surface 14 is a conductive coating 16 which may be in a variety of forms including conductive material coated thereon on by electro- deposition following a precoating of electroless conductive material through electrophoretic deposition. The invention also contemplates the use of conductive rubbers wherein conductive particles are held in mixture to facilitate flexible movement of the tubular element.

To be appreciated with respect to FIGS. 1A-1C, the drawings represent elements much enlarged from actual size which in a particular embodiment could find the outer diameter of tubular element 10 to be on the order of 0.040 inches with a constant wall thickness of wall 12 on the order of 0.005 inches.

The left hand view of FIG. 1A represents the tubular element in an undeformed or unactuated condition. The right hand view represents the tubular element deformed as by fluid pressure exerted evenly around the outside of the element surface, the arrow vectors there shown representing such pressure. As can be seen from FIG. 1A the tubular element is centrally constricted, evenly with the interior walls thereof, driven inwardly to reduce the inner diameter appreciably. The amount of reduction is a function of the elastomeric properties of the tubular element and the amount of pressure employed.

In FIG. 1B the tubular element 10 is shown in relationship to a contact pin 18 which is rounded at one end as at 19 and has a surface 20 preferably coated with a highly conductive material such as gold. As can be seen from the right hand side of FIG. 1B wherein the tubular element is deformed or actuated inwardly by fluid pressure a band or area of contact A.C. is created between the surface 14 carrying a conductive coating 16 and a portion of the surface 20 of 18. The contact area is substantially greater than the typical point contact of prior art connectors. FIG. 1C shows in the left hand view a substantial clearance between the surface 20 and the surface 14 allowing for insertion of a pin within 10 with little or no frictional drag and insertion force. The right hand view in FIG. 1C shows the pin tightly gripped around the periphery thereof to effect an interconnection between 16 and 20. A conductive trace or other conductive path not shown may interconnect 16 to other circuit paths. Thus it is that the invention embodiment represented in FIGS. 1A-1C represent an interconnection system between a device such as element 10 and the contact pin 18 through 16 to some further circuit. With pressure relieved, the tubular element 10 should open up to the condition in the left hand views or at least to an extended condition allowing a zero or low force withdrawal and reinsertion of pin 18.

Figures 2A, 2B, 2C:
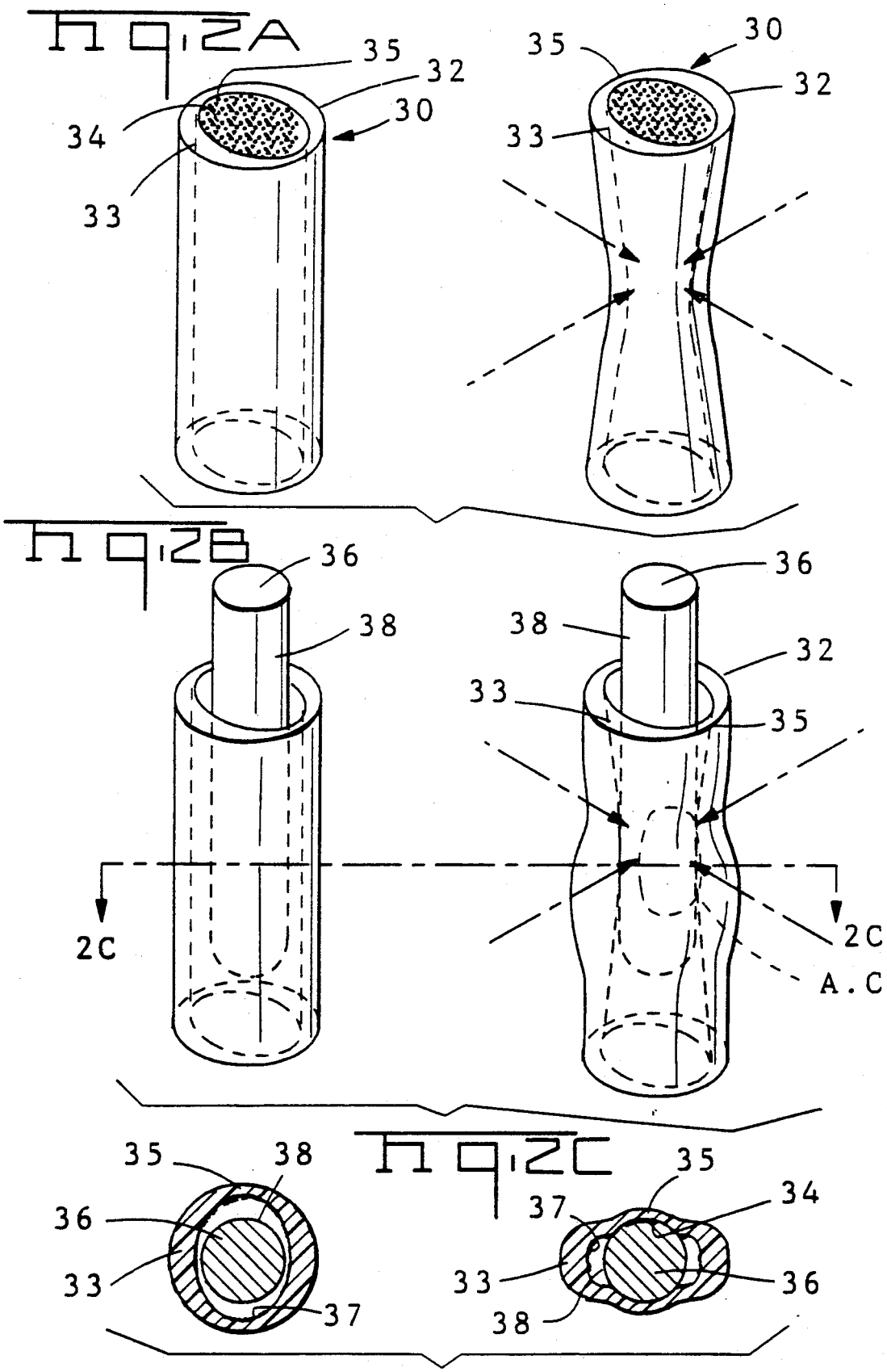
FIG. 2A is a perspective of an alternative tube element housing a varying wall thickness.
FIG. 2B is a view of the elements of FIG. 2A having pin contacts inserted therein.
FIG. 2C is a cross-sectional view through the center of the elements shown in FIG. 2B.

FIG. 2A shows a tubular element 30 comprised of a wall 32 which includes wall sections of varying thickness and an inner surface 34 which is essentially oval in cross section. The wall sections are thickest at the sides at 33 and thinnest at 35 sides. As can be seen in FIG. 2A, fluid pressure upon the periphery of element 30 deforms the material inwardly. In FIG. 2B the element 30 can be seen to receive a contact pin 6 having an exterior surface 38 inserted freely within element 30 when such element is in its undeformed condition. As shown in FIGS. 2B and 2C deformation by fluid pressure forcing the interior wall 34 inwardly operates differentially upon the thin portions 35 to force an engagement with the surface 38 and 36 into two areas of contact opposite each other. An increased pressure would increase the area of A.C. and a decreased pressure would decrease such area of contact. In this manner, selective areas of contact may be developed by changing the geometry of the wall thickness of the contact element 30. In this way a conductive coating such as 37 selectively applied as indicated in FIG. 2C may be made to engage a selective coating or plating on pin 36 proximate to the region of the plating 37 to reduce the usage of finishes such as gold as applied to the pin contact 36.

Figures 3A, 3B, 3C:
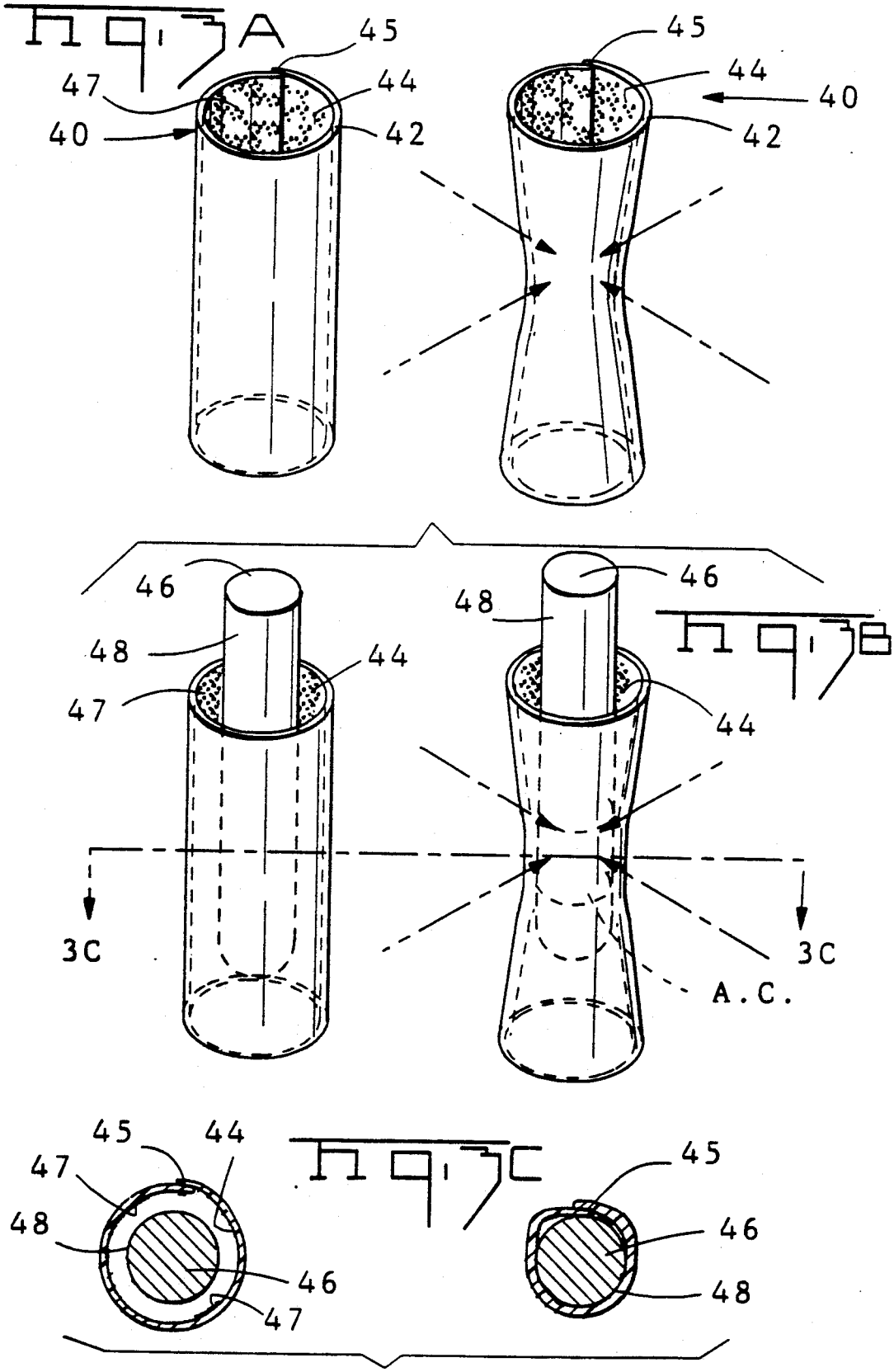
FIG. 3A is a perspective of a further alternative embodiment of the invention formed of sheet material, seam bonded to form a tubular geometry.
FIG. 3B is a perspective of the elements of FIG. 3A having pin contacts inserted therein.
FIG. 3C is a cross-sectional view of the elements shown in FIG. 3B.

FIGS. 3A-3C show a further alternative of the invention involving a tubular element 40 formed of flat stock which is rolled into tubular form and joined at the ends to form a seamed tube. Element 40 includes a wall 42 having an interior surface 44 and a seam 45 where the end portions of 42 are bonded together as by ultrasonic welding or suitable adhesives. .As can be seen in FIG. 3A, the application of a fluid pressure inwardly results in a deformation of the element 40 in the manner heretofore described In FIGS. 3B and 3C, at left, a pin contact 46 having an exterior conductive surface 48 is shown inserted within element 40 in its undeformed or enlarged condition so the pin may be inserted freely with zero or minimum insertion force entailed. FIGS. 3B and 3C to the right show the result of fluid pressure deformation inwardly of the wall sections of 42 to engage and define an area of contact A.C. engaging surface 48 of pin 46. As can be seen in FIG. 3C the engagement is not complete due to both the added rigidity of the seam 45 which allows the pressure to work differentially on the walls 42, it being understood that additional pressure would drive the walls 42 further inwardly and that lesser pressure would result in a lesser area of contact. Conductive material in the form of a coating 47, applied interiorly to wall 44 will result in an interconnection between the tubular element 40 and contact pin 46.

It should be also apparent that an increase in pressure may be made to increase the area of contact A.C. longitudinally as the area spreads upwardly and downwardly relative to deformation of the tubular element.

Referring now to FIGS. 4A–4F an embodiment of the invention is shown wherein pin elements of different diameters are interconnected through a longitudinal insertion into the tube element. With respect to FIGS. 4A–4C, circular pin elements 18 and 22 having different diameters are inserted within the tubular element 10 which is shown in these figures in a deformed or actuated condition to bring the inner surface wall 14 and the conductive coating 16 thereon into engagement first with the conductive surface 20 of pin 18 and then with the conductive surface 24 of pin 22. As indicated in FIG. 4B the larger diameter pin 18 will result in an area contact A.C. forming a complete band and relatively broad area of contact with pin 18 whereas the smaller diameter pin 22, for a given pressure may have a differential area of contact A.C. with gaps indicated as N.C. for no contact. It is understood that increased pressure may drive the elastomeric material into lower regions of the element 10 further inwardly to increase the area of contact A.C., the elastomeric nature of the contact element 10 accommodating a deformation differentially.

In FIGS. 4D–4F the tubular element 10 is utilized to interconnect a pair of posts 28 and 29 having non-circular cross-sectional profiles; post 28 being square, and post 29 being triangular. As can be discerned from FIGS. 4D–4F deformation of element 10 will result in a differential engagement with the posts the contact areas being initially with the edges and spreading to flat portions with increased deformation. In this way multiple areas of contact A.C. may be provided. Also to be appreciated is the intrinsic accommodation to pin geometry variation due to the tolerance variation.

Figure 5A:
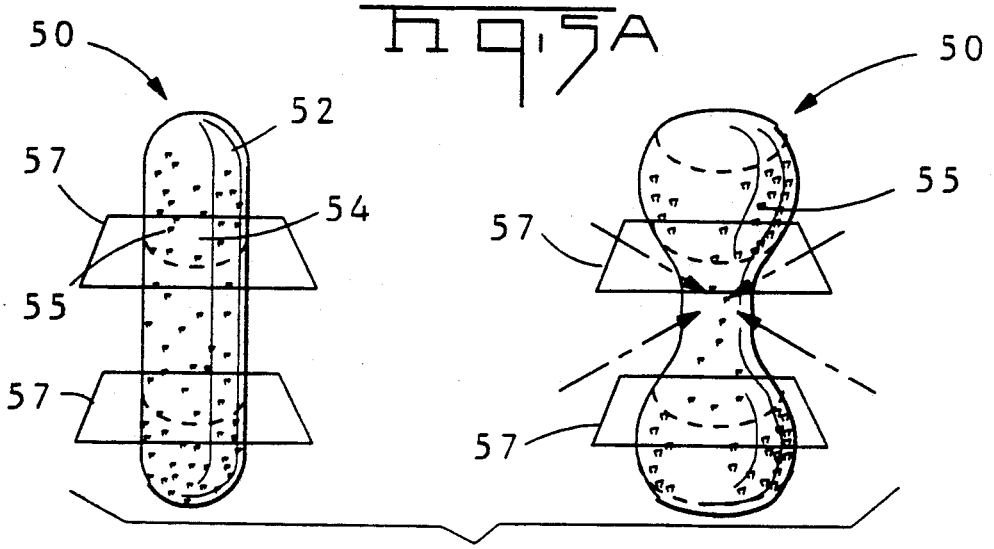
FIG. 5A is a perspective of yet a further embodiment of the invention shown in unactivated and activated conditions in a closed capsule embodiment.
Figure 5B:
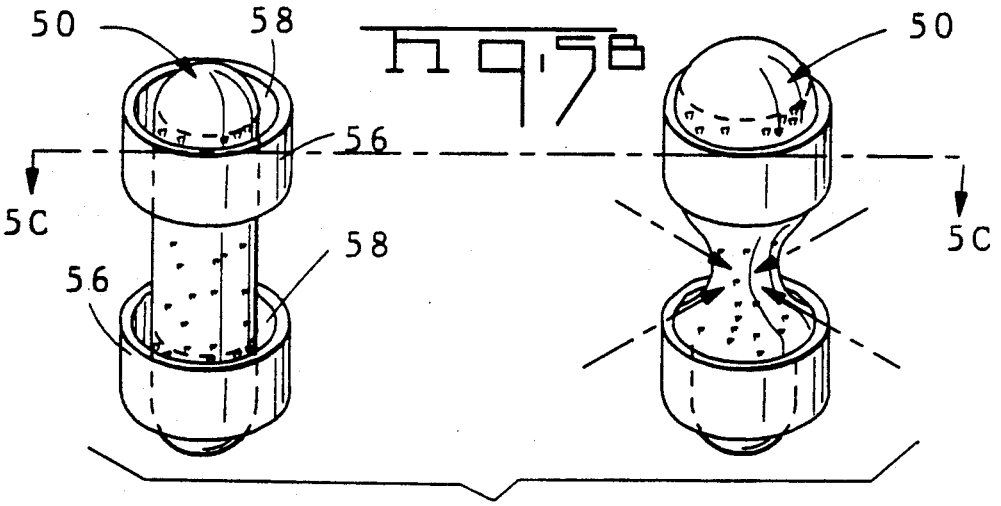
FIG. 5B is a view of the elements of FIG. 5A and further including ring shaped contact elements to be interconnected by the contact element of FIGS. 5A.
Figure 5C:
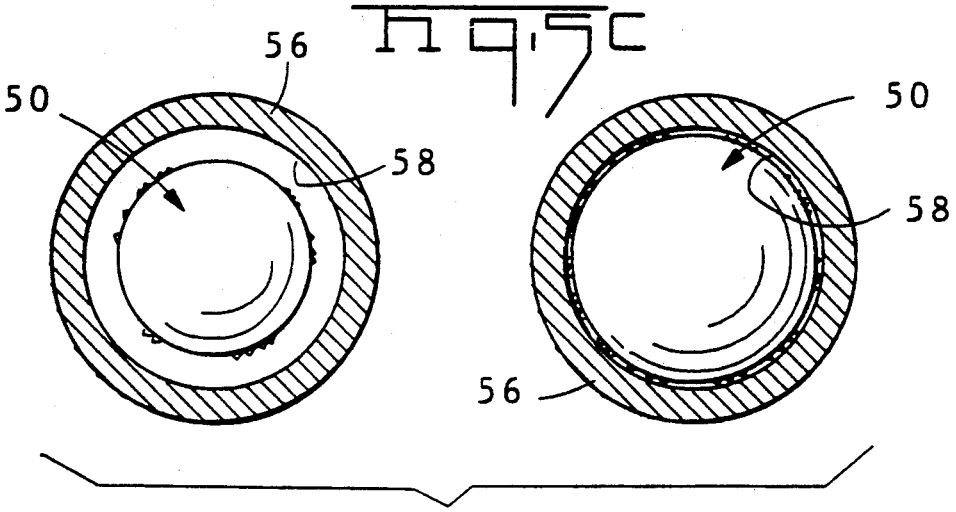
FIG. 5C is a cross-sectional view taken through the upper end of the elements shown in FIG. 5B.

Referring now to FIG. 5A–5C an alternative embodiment of the invention is shown in the form of a tubular element 50 which is capsule like. The wall 52 thereof is closed at its ends to define an interior volume 54 which itself may be filled with a fluid, the pressure of which may be controlled to alter the spring characteristics of the capsule with respect to fluid pressure applied externally. The element 50 includes a conductive coating on the exterior thereof shown as 55. Pairs of gland membranes 57 are provided surrounding element 50 as indicated in FIG. 5A to facilitate pressure differential. The left hand view of FIG. 5A shows the capsule in a relaxed condition and the right hand view shows the capsule deformed and actuated by a fluid pressure applied toward its center around the periphery thereof. FIG. 5B shows the element 50 as fitted between a pair of ring shaped contact elements 56 disposed generally at the ends of 50 and each including an interior conductive surface 58 made to connect to the conductive surface 55 of the element 50 upon the deformation as indicated in FIGS. 5B and 5C, the right hand views. With respect to the embodiment of the invention shown in FIGS. 5A–5C, the contact rings 56 may be taken to represent contact areas in board holes connected to different circuit paths such as the several levels of traces in a printed circuit board. In this use the upper contact element 56 would form part of a first board and the lower contact element 56 would form part of a second board with an interconnection of the boards being made by actuation of the connector 50 and conduction via conductor coating 55.

Figure 6A:
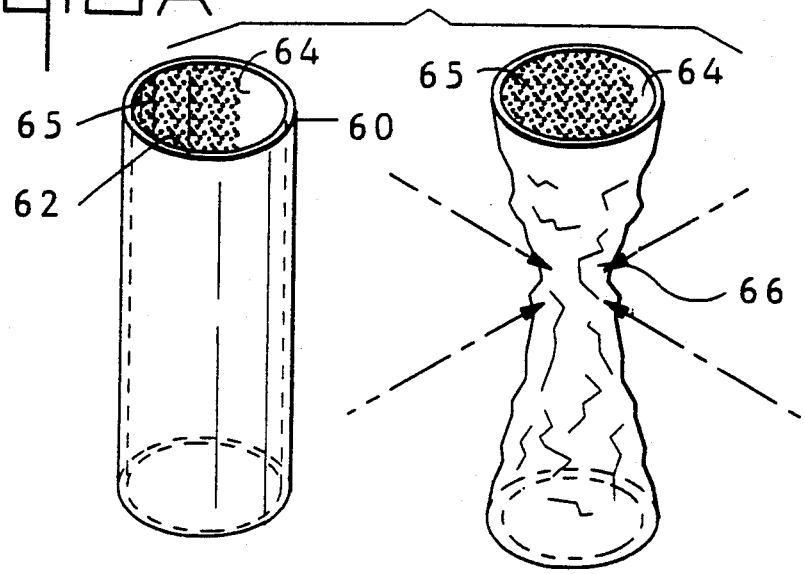
FIG. 6A is a perspective of tubular elements formed of inelastic material in the relaxed and deformed conditions.
Figure 6B:
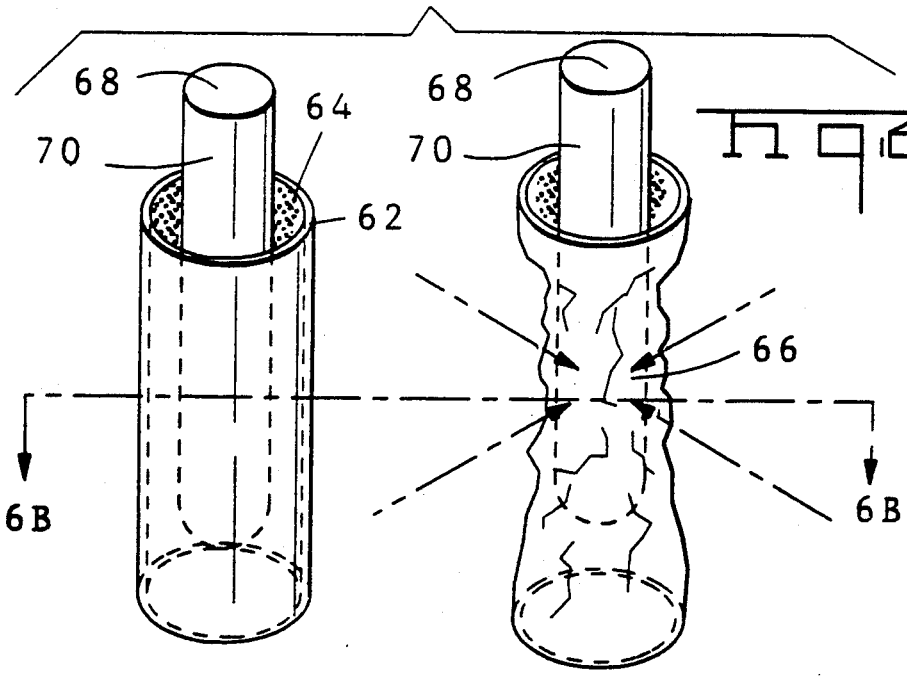
FIG. 6B is a perspective of the elements of FIG. 6A having pin elements inserted therein.
Figure 6C:
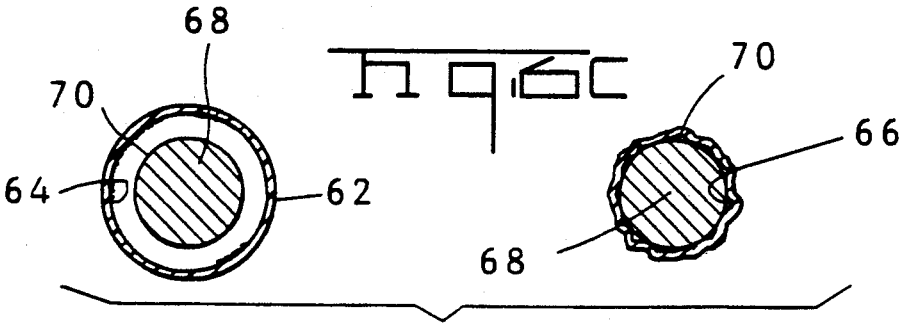
FIG. 6C is a sectional view through the center of the elements shown in FIG. 6B.

In FIGS. 6A–6C a further alternative embodiment is shown which includes a tubular element 60 having a wall 62 and an interior surface 64 with a suitable conductive coating 65 therein. The wall thickness 62 of connector 60 is contemplated as being relatively thinner than the wall thicknesses of the contacts heretofore described. The wall thickness of 62 may be on the order of less than 0.001 to 0.003 inches. A second aspect of the embodiment of FIGS. 6A–6C is that the material of element 60 may be non-elastomeric, having characteristics like that of polyester film which is recommended for use. Such film has little if any intrinsic elasticity or memory, being considered a thermoset type plastic which is frequently produced by calendaring rather than molding or casting. Despite the fact that the material itself is relatively inelastic, the tubular geometry has been found to make the element 60 have a degree of memory so as to return partially to its original shape from a fluid pressure deformation, sufficient to provide a slight withdrawal force or insertion force upon reinsertion. This deformation is shown in FIG. 6A to result in an inward "crinkling" of the wall 62, such surface result being depicted as 66 in the right hand views of FIGS. 6A–6C. FIG. 6B shows the element 60 having a pin contact 68 inserted therein which includes an outer conductive surface 70 engaged by the conductive surface 65 interiorly of element 60 upon application of the deforming fluid pressure. Upon such deformation of a thin wall device and the resulting "crinkling" a multi-contact engagement between the conductive interior of element 60 and the pin 68 will occur.

Figures 7A, 7B, 7C:
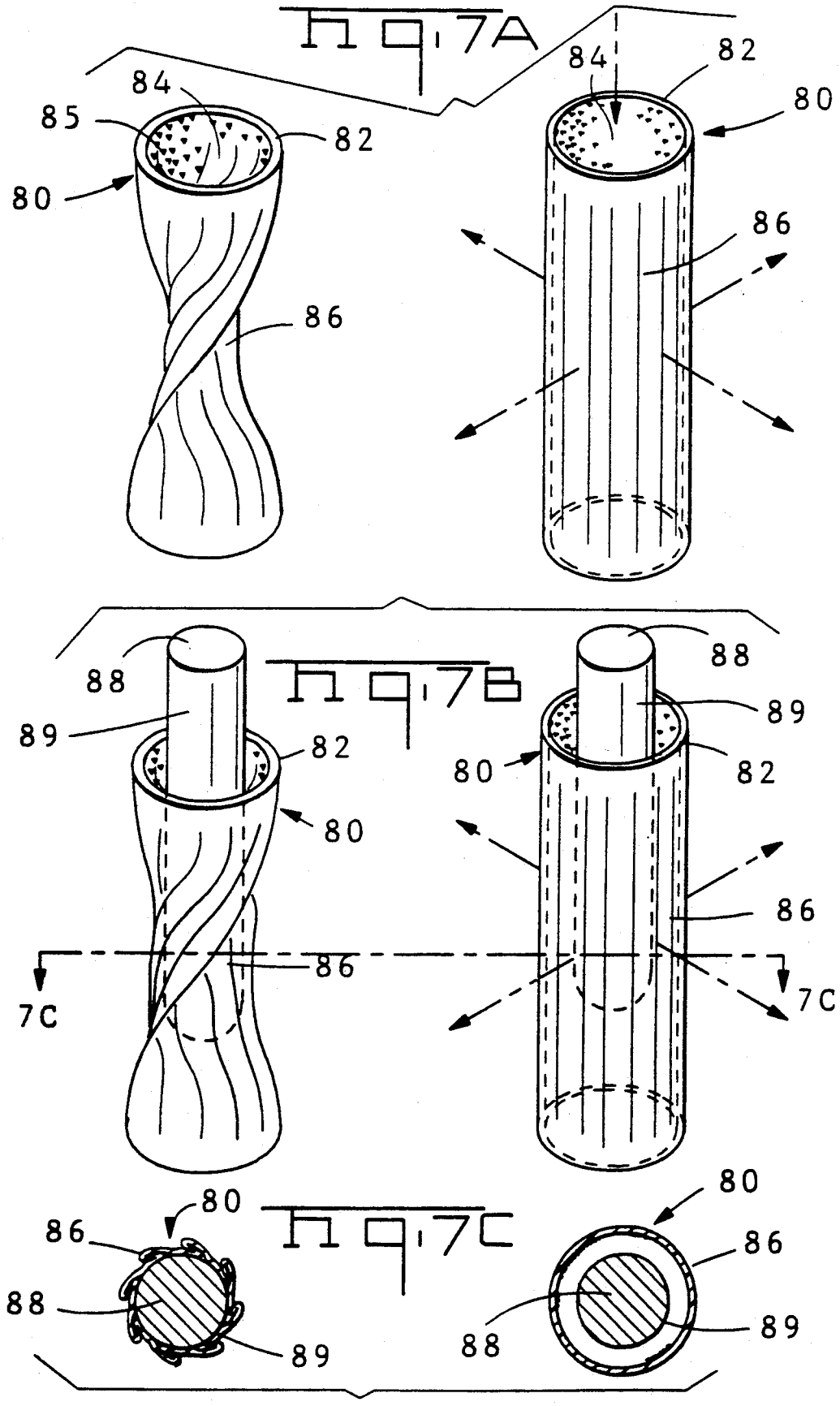
FIG. 7A is a further alternative of the invention showing an inelastic pleated tubular element in deformed and expanded conditions.
FIG. 7B is a view of the elements of FIG. 7A having pin contacts inserted therein.
FIG. 7C is cross-sectional view through the center of the elements shown in FIG. 7B.

In FIGS. 7A–7C an alternative embodiment of the invention is shown in the form of a tubular element 80 including a wall 82 and an interior surface 84 carrying a conductive coating 85 thereon. The element 80 is formed of thin wall material such as polyester and is made to have a series of pleats 86 therein in the forming of the contact so as to define an hourglass shape with a constricted interior in the relaxed and undeformed condition as indicated in FIG. 7A, the left hand view. With respect to the FIGS. 7A–7C an aspect of the invention relating to the application of fluid pressure is reversed from that heretofore described. In the application shown in FIGS. 7A–7C a negative pressure is applied to the exterior of element 80 causing it to expand or open up allowing the free entry of a contact pin 88 carrying a conductive surface 89 for engagement with the conductive coating 85 interiorly of 80. Thus, with the element 80 actuated into an open condition, the contact pin 88 is inserted therein and the negative pressure removed with the element 80 returning to its original condition of inward deformation, twisting as it closes inwardly to provide a multipoint contact with surface 89 which wipes as the interior folds of 80 engage 89. With the exception of the teaching of FIGS. 5A-5C, the invention fully contemplates the use of positive and negative pressures with respect to all of the embodiments heretofore described, it being understood that means to apply a vacuum to a set of tubular elements temporarily to open such contacts followed by insertion of pin contacts and removal of such vacuum is contemplated. Thus, with respect to the teachings in FIGS. 1A-1C, the molded condition of contact 10 would be as shown in the right hand view of FIGS. 1A-1C with the actuated condition shown in the left hand views. So too, with the rest of the embodiments. It is also contemplated that a positive pressure applied internally as from one or both ends of the tube contact may serve to open an inwardly deformed tube to allow the zero or low force insertion of pins therewithin.

Referring now to FIGS. 8A-8C, an embodiment of the invention is shown in the form of a tubular element 90 having a wall 92 and an interior surface 94 carrying a conductive coating 95 which is also made to extend exteriorly of the tube. One end of the element 90 is closed as at 96 and folded within the tube in the manner shown. FIGS. 8B and 8C show a pin contact 98 having an exterior conductive surface 100 inserted within element 90 and a further pin contact 102 inserted therewithin at the lower end engaging the inwardly folded portion 96. The application of fluid pressure upon the exterior of the element 90 results in the deformation shown in the right hand views of FIGS. 8B and 8C to effect an interconnection with the pin contacts 98 and 102 and through the conductive surface 95 between such pin contacts With respect to the embodiment here shown, it is contemplated that one of the pins, such as pin 102, may be alternatively welded as by ultrasonics to the conductive surface 95 in order to make a permanent connection thereto, the other connection to pin 98 being effected by fluid pressure.

Figure 9:
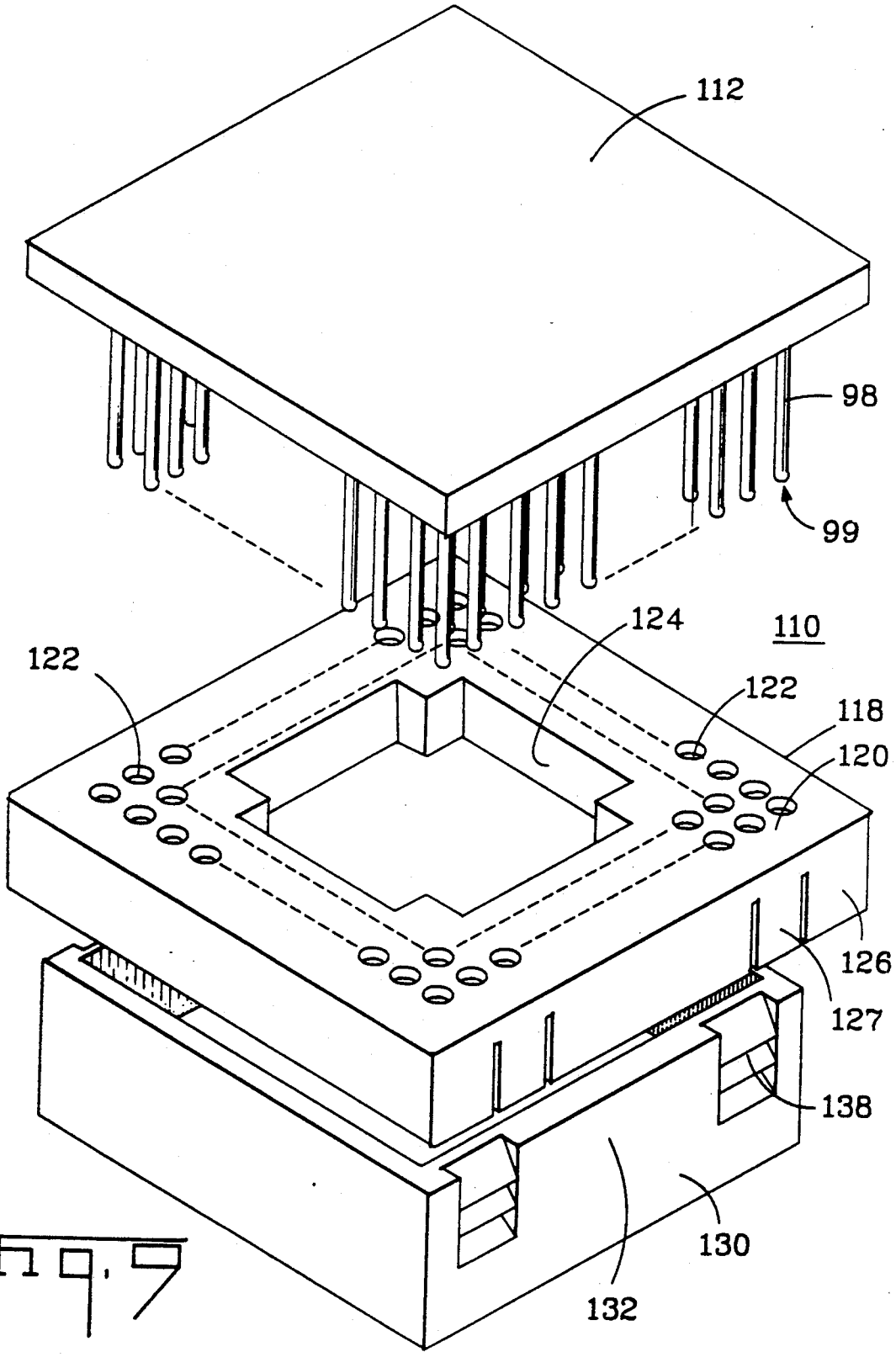
FIG. 9 is a perspective view of a connector package in an unassembled condition.

FIG. 9 shows a connector assembly 110 adapted to interconnect to a multi-pin integrated circuit package 112 having an array of contact pins 98 extending therefrom in rows around the periphery of the device. The pin contacts 98 end as at 99, reference being heretofore made to the tubular elements 90 shown in FIGS. 8A-8C. Integrated circuit packages come in a variety of forms including ceramic, glass, plastic and the like, but typically conform to standards in terms of the pin arrays or pin grid array construction, some of which having as many as several hundred pins extending therefrom. Positioned beneath the package 112 is a connector 118, shown disassembled, to include an upper plastic cover 120 apertured as at 122 in rows matching the center lines of the contacts 98 of package 112. Interiorly of the housing cover is a relief shown as 124 intended to accommodate protrusions beneath the center surface of 112 which form part of the packaging of certain types of integrated circuits. The cover 120 further includes sidewalls 126 which contain latch elements 127 best observed in FIG. 10. At the ends of latches 127 are inwardly directly latch elements 128. Also shown in FIG. 10, proximate each aperture 122 is a bevelled entry 123 adapted to receive and guide the bevelled ends 99 of contact pins 98 during insertion. Adjacent the bevelled portions 123 are sleeves 129 which fit into elements 90. Extending around the periphery and acting to hold in position the ends of tubular elements 90 are projections shown as 131.

Figure 10:
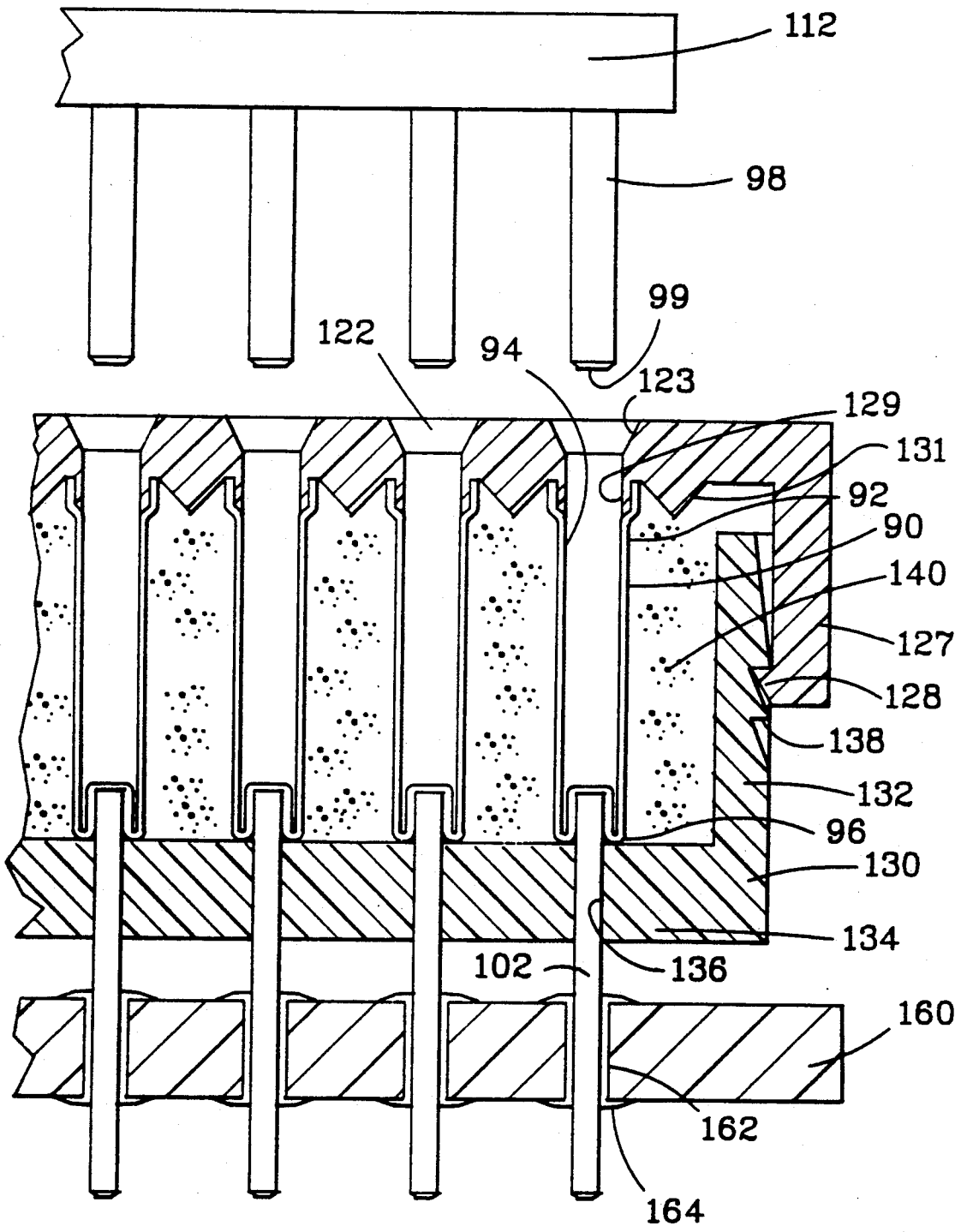
FIG. 10 is an elevational and partially sectional view of the package of FIG. 9 as assembled for functional use but prior to the insertion of pin contacts therein and prior to actuation.
Figure 11:
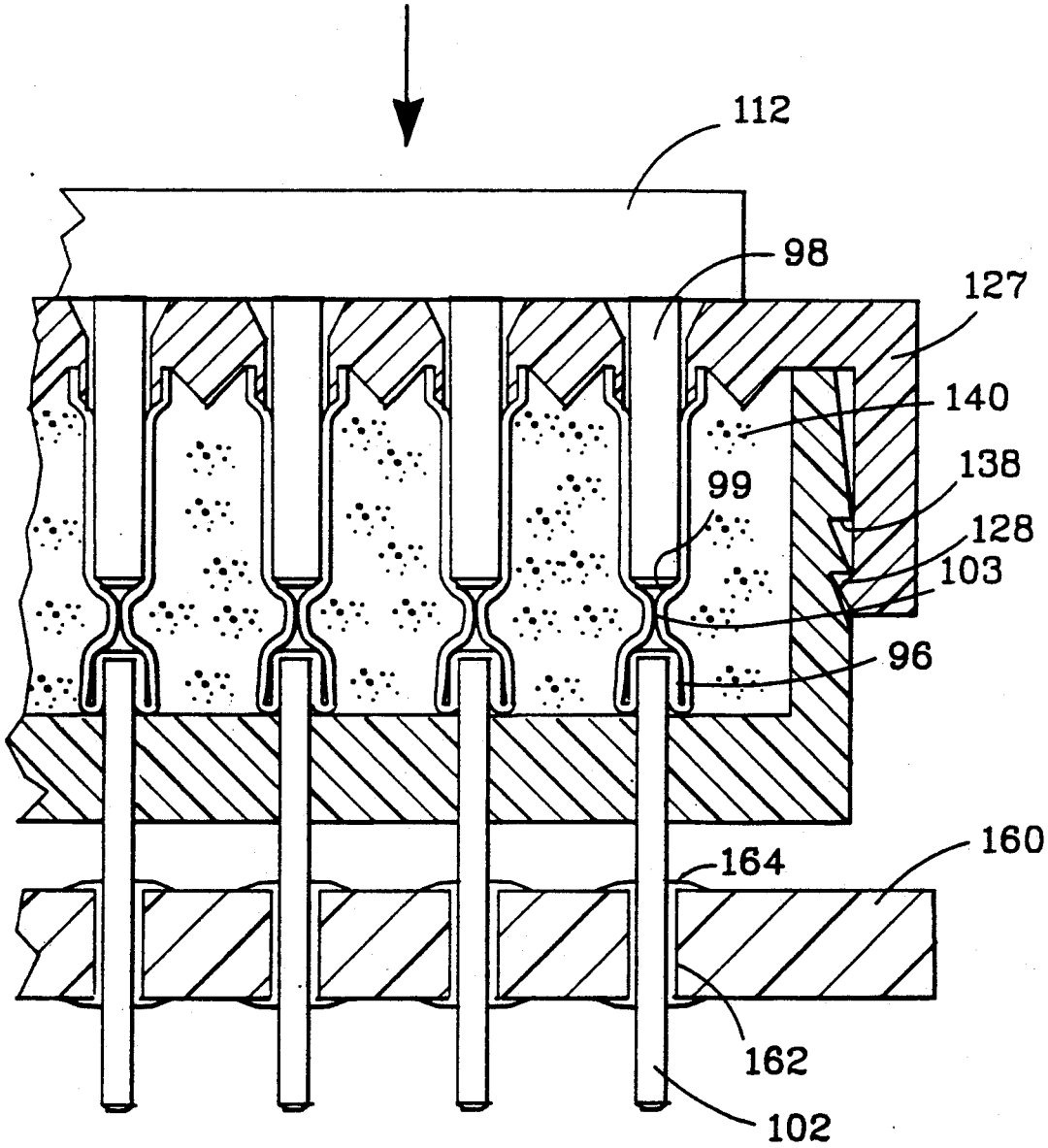
FIG. 11 is a view of the package of FIG. 10 having the pin contacts inserted therein and the tubular elements actuated.

The package 118 includes a bottom 130 having sidewalls 132, a base or floor portion 134, apertured at 136 to carry an array of contact pins 102 which extend through 136 into the interior of the bottom 130. As can be seen in FIGS. 9 and 10, the outside walls of 130 include a series of latch surfaces 138 complimentary to and mating with the latch element 128 formed inwardly of the top 120. The bottom 130 is in the embodiment of FIGS. 9-11 filled with a gel 140 which has fluid characteristics, is relatively incompressible, and has dielectric properties. One such gel is a commercial dielectric gel No. 527 from Do Corning, Midland, Mich. As can be seen in FIGS. 9 and 10, the contact pins 102 protruding from the bottom 130 are fitted into and soldered into a board 160 which may be taken to be a printed circuit board having one or more conductive trace layers. Board 160 includes apertures 162 through which are fitted contacts 102 and soldered thereto as at 164. The package 118 is fitted on board 160 in the open or undeformed and unactuated condition shown in FIG. 10 is ready to receive the I.C. package 112 with the contacts and pins 98 inserted into the interiors of the tubular elements 90. Once this is done and the integrated circuit package 112 seated on the top 120, pressure downwardly applied against the top will force it to move down to a position as shown in FIG. 11 with the gel 140 generating fluid pressure in the manner heretofore described to close the contacts 90 in the manner described with respect to FIGS. 8A-8C. This closure will effect an interconnection from the contact pins 98 to the contact pins 102 through the conductive coating 95 of elements 92. As can be seen, the length dimension of the contact 92 which must be diminished by the downward movement of the top is accommodated by the collapse shown as 103 in FIG. 11. Suitable seals not shown may be employed to maintain gel pressure.

To remove the package 112 the latches 127 must be opened outwardly and the top 120 displaced upwardly. The tubular elements 90 will relax toward the open conduction to release the grip on pins 98. As heretofore mentioned, it may be preferable to have contact pins 102 welded as by ultrasonics to the tubular elements 90 as at 96 to reduce the contact interface resistance of the overall interconnection.

While the embodiments of FIGS. 9-11 have illustrated the use of a fluid such as a gel, the use of gases, including air, is fully contemplated, using suitable seals to maintain pressure. Also contemplated is the use of elastomeric materials which are sufficiently fluid in nature in that they flow readily when compressed.

While a mechanism for generating the positive pressure has been illustrated with respect to the package of FIGS. 9-11, externally generated positive and negative pressures are contemplated for use with the invention in packages which are essentially sealed with respect to a top and bottom except for inlets and outlets to facilitate the introduction of positive or negative pressures measured and maintained by external means.

And as mentioned, the invention contemplates a tubular element essentially closed in the relaxed condition to be temporarily opened by pressure, positive or negative, followed by pin insertion and then a removal of pressure to achieve contact.

Having now described the invention in terms intended to enable a preferred practice thereof and its alternative embodiments, I now set forth what is defined as the invention through the appended claims:

What is claimed is:

1. An electrical interconnection device comprising a first contact having a tubular portion formed of plastic material to define a thin wall of a thickness facilitating radial displacement in the center of the length of said portion and including a conductive surface interiorly on said wall, said first contact having a first radial geometry in a relaxed condition and a second radial geometry in a stressed condition as driven by fluid pressure applied to said wall against one side thereof, means to apply said fluid pressure, a second conductive contact positioned interiorly of said first contact to be electrically interconnected thereto by the application of said pressure to effect said second geometry and displace the wall and conductive surface of said first contact into engagement with the second contact to effect said interconnection.

2. The device of claim 1 wherein in that said means to apply said fluid pressure includes means to apply a positive pressure against the wall of said first contact.

3. The device of claim 1 wherein in that said means to apply said fluid pressure includes means to apply a negative pressure to said wall of said first contact.

4. The device of claim 1 wherein said first contact tubular portion has both ends thereof open for insertion of a contact therewithin.

5. The device of claim 1 wherein in that said first contact includes one end thereof closed and the other end thereof open for insertion of said second contact therewithin.

6. The device of claim 1 wherein the material of said first contact is elastomeric.

7. The device of claim 1 characterized in that the first contact material is non-elastic.

8. The device of claim 7 wherein the said first contact is formed of a seamless material.

9. The device of claim 1 wherein said first contact is formed of a material including a seam.

10. The device of claim 1 wherein the said first contact includes a varying wall thickness extending along the length thereof to provide a differential radial deformation thereof responsive to said pressure.

11. The device of claim 1 wherein the said wall is of a constant thickness.

12. The device of claim 1 wherein the said first contact is formed of a conductive material.

13. The device of claim 1 wherein the said conductive surface is formed by deposition on the said wall.

14. The device of claim 1 wherein the said conductive surface extends on one side of said wall.

15. The device of claim 1 wherein the said conductive surface extends on both sides of said wall and is interconnected inside to outside.

16. The device of claim 1 where the said second contact is defined by essentially a round post.

17. The device of claim 1 wherein the said second contact has at least two flat sides.

18. The device of claim 1 wherein the said first contact has one end closed and folded within the contact to form a second tubular portion to receive a further contact inserted therewithin.

19. The device of claim 1 wherein there is included a third contact and the said second and third contacts are disposed to be engaged by the conductive surface of said first contact to interconnect said second and third contacts together.

20. The device of claim 1 wherein the said first contact includes at least one fold therein with the said fold being driven to increase the circumference of said first contact tubular portion responsive to the application of said pressure.

21. The device of claim 20 wherein the said first contact fold effects a wiping of the said second contact upon application of said pressure.

22. An interconnection system adapted to receive and interconnect an electronic package including an array of post contact members, which extend axially parallel in a given pattern said system including a plurality of first contacts each having a tubular cross section and a conductive surface and each formed of a thin wall plastic material readily deformable in a radically inward sense, the said first contacts being arranged in axially parallel patterns matching axially disposed patterns of post contact members of the package, a housing having a means sealing the interior of the housing with said first contact members mounted in said housing in said pattern and a fluid medium contained within said housing and means to pressurize said fluid medium to drive said first contacts radially inwardly into engagement with the said post contact members of said package to provide an interconnection thereto.

23. The system of claim 22 wherein there is further provided a second array of contact members interconnected to a further electronic package with said further contact members extending within said housing to engage the conductive surfaces of said first contact members.

24. The system of claim 22 wherein the said housing is comprised of a top and a bottom including telescoping surfaces allowing relative displacement to effect said pressure and means are provided to hold said top and bottom relatively together to maintain said fluid pressure.

25. The system of claim 23 wherein the said fluid medium is a gas.

26. The system of claim 22 wherein the said fluid medium is a gel.

27. The system of claim 22 wherein the said fluid medium is an elastomer readily flowable under pressure.

28. An interconnection system including a tubular element formed of a thin wall material having a conductive surface to form a first contact, said element having characteristics of flexibility under pressure to be displaced radially from the first diameter inwawrdly to a reduced diameter toward the center of the longitudinal axis of said tubular element, a second conductive contact displaceable from a point removed from said element parallel to said longitudinal axis to point proximate said element, means to apply a radially inward pressure to said element to cause it to flex into engagement interconnecting to said second contact, the said tubular element having a memory such that in the absence of pressure, the element returns to the first diameter to minimize engagement and frictional force between the first and second contacts.

29. The system of claim 28 wherein the said second contact is a pin inserted within said tubular element.

30. The system of claim 28 wherein the said second contact is external of said tubular element and said tubular element is sealed to be expanded proximate said second contact by the reduced diameter to effect said interconnection.

31. The system of claim 28 wherein the said thin wall is on the order of under 0.005 inches in thickness.

32. The system of claim 28 wherein the said thin wall is on the order of less than 0.001 inches in thickness.

33. The system of claim 28 wherein the said thin wall outside diameter is on the order of less than 0.040 inches.

* * * * *